US011140961B2

(12) United States Patent
Fields et al.

(10) Patent No.: US 11,140,961 B2
(45) Date of Patent: Oct. 12, 2021

(54) TOE NAIL CLIPPING DEVICE

(71) Applicants: Arnold Fields, Chesapeake, VA (US); Myra Fields, Chesapeake, VA (US)

(72) Inventors: Arnold Fields, Chesapeake, VA (US); Myra Fields, Chesapeake, VA (US)

( * ) Notice: Subject to any disclaimer, the term of this patent is extended or adjusted under 35 U.S.C. 154(b) by 376 days.

(21) Appl. No.: 16/191,670

(22) Filed: Nov. 15, 2018

(65) Prior Publication Data

US 2020/0154847 A1 May 21, 2020

(51) Int. Cl.
*A45D 29/02* (2006.01)

(52) U.S. Cl.
CPC ..... *A45D 29/02* (2013.01); *A45D 2029/026* (2013.01)

(58) Field of Classification Search
CPC ..... A45D 29/02; A45D 2029/023; A45D 2029/026; A45D 29/18
See application file for complete search history.

(56) References Cited

U.S. PATENT DOCUMENTS

D286,091 S * 10/1986 Hill ..... D24/147
4,847,994 A * 7/1989 Dunn, Jr. ..... A45D 29/02 30/28
4,893,406 A 1/1990 Larson
5,357,677 A 10/1994 West
5,749,377 A 5/1998 Desario
5,775,340 A * 7/1998 Rains ..... A45D 29/02 132/73.5
6,539,632 B2 * 4/2003 Anctil ..... A45D 29/02 30/131
6,601,587 B2 * 8/2003 Shaw ..... A45D 29/18 132/75.3
D667,588 S 9/2012 Gibbs
9,486,051 B1 * 11/2016 Robinson ..... G02B 25/005

* cited by examiner

*Primary Examiner* — Yogesh P Patel
*Assistant Examiner* — Jennifer Gill

(57) ABSTRACT

A toenail clipping device for decreasing a reach required for trimming a toenail includes a clippers, which in turn comprises a clip lever that is operationally coupled to a pair of cutters. The cutters are mutually coupled to define a gap that is positioned at a first end of the clippers. A rod is coupled to and extends substantially perpendicularly from a second end of the clippers. The rod is configured to be grasped in a hand of a user, positioning the user to manipulate the clippers to insert a portion of a toenail into the gap. An actuator is coupled to the rod distal from the clippers and is operationally coupled to the clip lever. The actuator is configured to be actuated by a digit of the hand grasping the rod to lever the clip lever to close the gap to clip the portion of the toenail.

1 Claim, 5 Drawing Sheets

TOE NAIL CLIPPING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relate to clipping devices and more particularly pertains to a new clipping device for decreasing a reach required for trimming a toenail.

BRIEF SUMMARY OF THE INVENTION

An embodiment of the disclosure meets the needs presented above by generally comprising a clippers, which in turn comprises a clip lever that is operationally coupled to a pair of cutters. The cutters are mutually coupled to define a gap that is positioned at a first end of the clippers. A rod is coupled to and extends substantially perpendicularly from a second end of the clippers. The rod is configured to be grasped in a hand of a user, positioning the user to manipulate the clippers to insert a portion of a toenail into the gap. An actuator is coupled to the rod distal from the clippers and is operationally coupled to the clip lever. The actuator is configured to be actuated by a digit of the hand grasping the rod to lever the clip lever to close the gap to clip the portion of the toenail.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
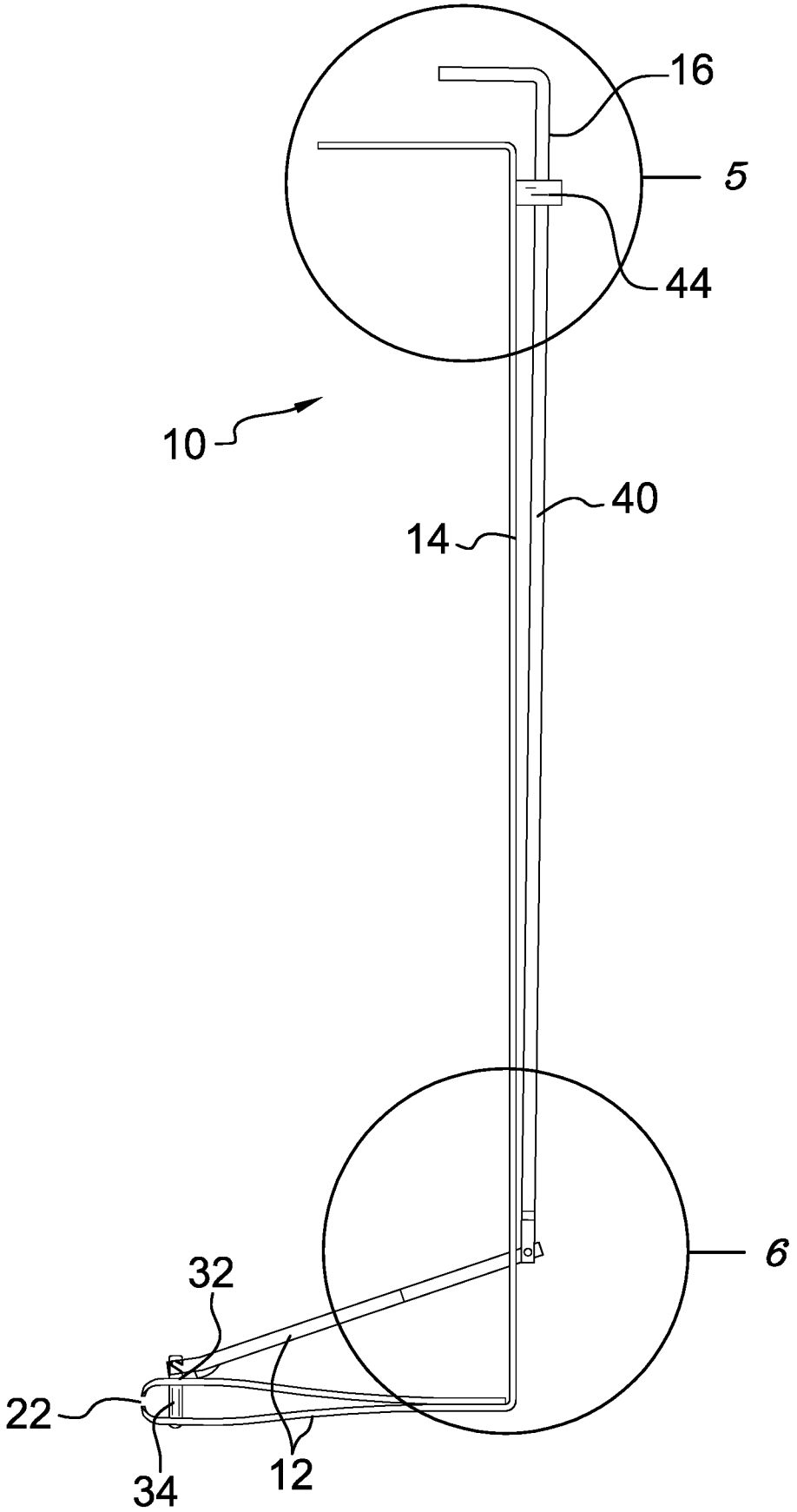
FIG. 1 is a side view of a toenail clipping device according to an embodiment of the disclosure.
Figure 2:
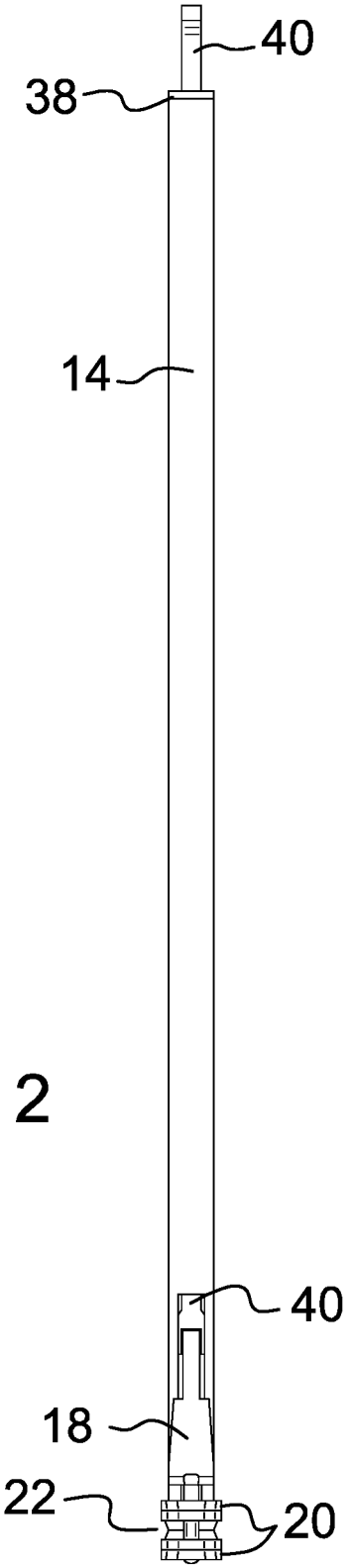
FIG. 2 is a front view of an embodiment of the disclosure.
Figure 3:
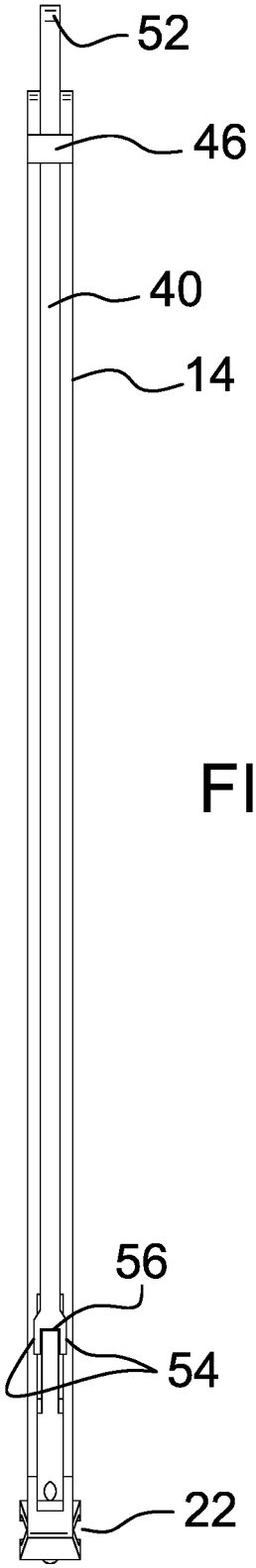
FIG. 3 is a rear view of an embodiment of the disclosure.
Figure 4:
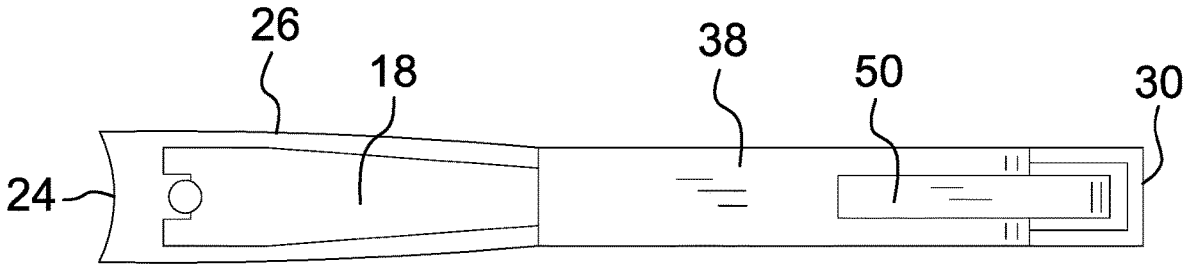
FIG. 4 is a top view of an embodiment of the disclosure.

With reference now to the drawings, and in particular to FIGS. 1 through 6 thereof, a new clipping device embodying the principles and concepts of an embodiment of the disclosure and generally designated by the reference numeral 10 will be described.

Figure 5:
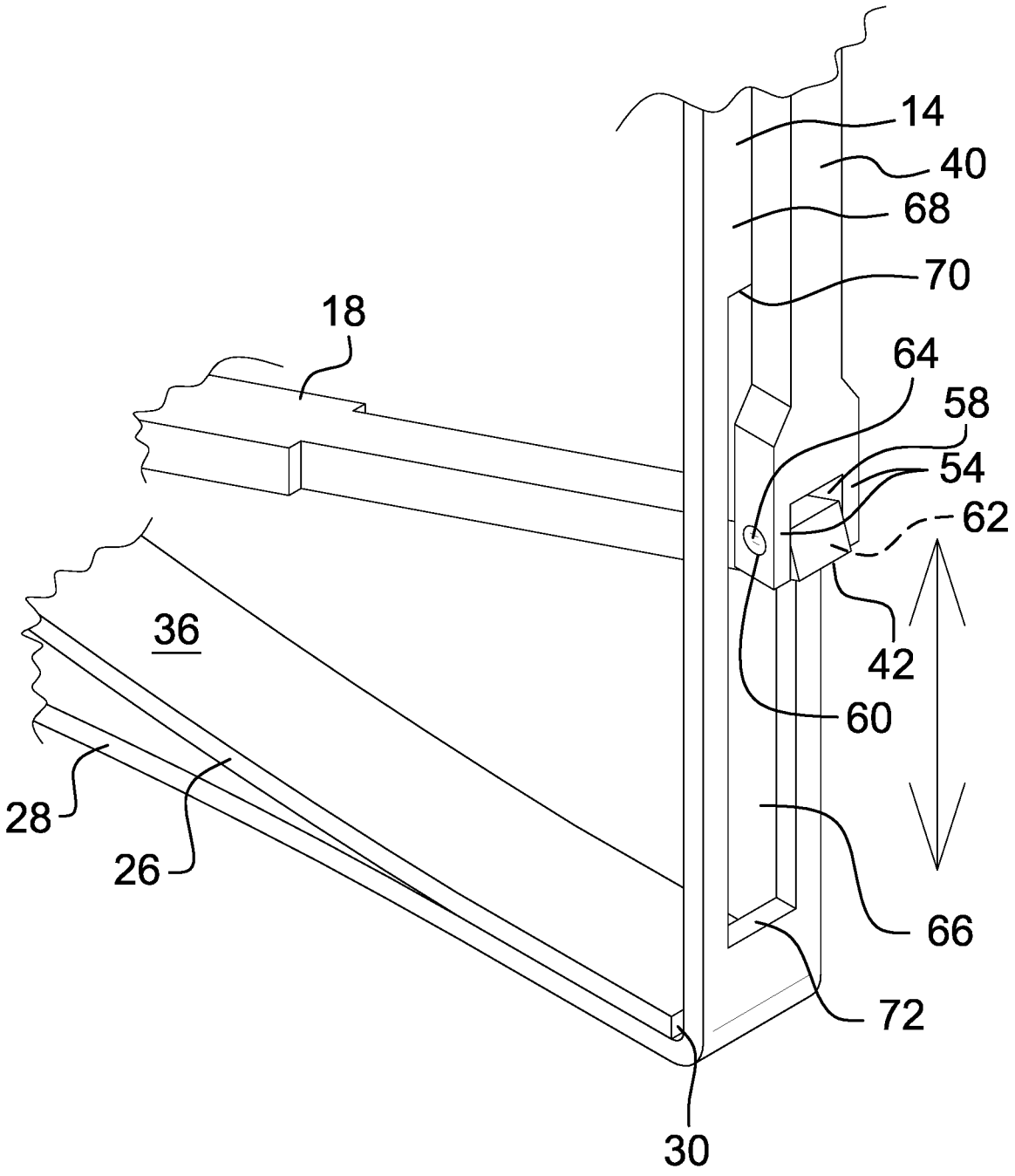
FIG. 5 is an isometric perspective view of an embodiment of the disclosure as indicated by detail area 5 in FIG. 1.

As best illustrated in FIGS. 1 through 6, the toenail clipping device 10 generally comprises a clippers 12, a rod 14, and an actuator 16. The clippers 12 comprises a clip lever 18 that is operationally coupled to a pair of cutters 20. The cutters 20 are mutually coupled to define a gap 22 that is positioned at a first end 24 of the clippers 12. The gap 22 is configured to insert a portion of a toenail so that the clip lever 18 is positioned to be selectively levered to close the gap 22 to clip the portion of the toenail. The pair of cutters 20 comprises an upper cutter 26 that is coupled to a lower cutter 28 adjacent to a second end 30 of the clippers 12, as shown in FIG. 5.

A hole 32 is positioned in the upper cutter 26 proximate to the first end 24 of the clippers 12, as shown in FIG. 1. A post 34 is coupled to the lower cutter 28 and extends substantially perpendicularly from the lower cutter 28 through the hole 32. The clip lever 18 is pivotally coupled to the post 34 so that the clip lever 18 extends transversely from an upper face 36 of the upper cutter 26.

Figure 6:
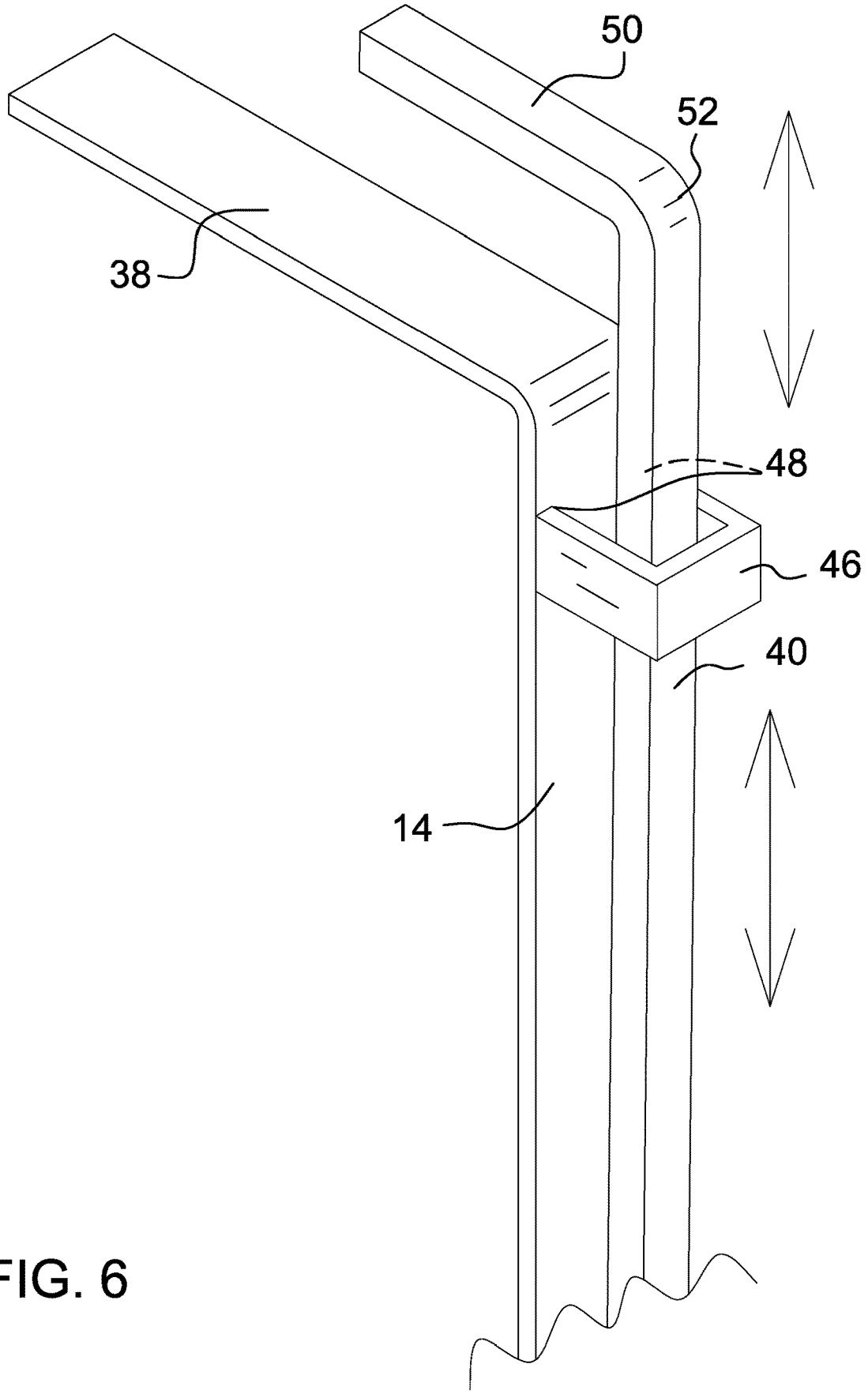
FIG. 6 is an isometric perspective view of an embodiment of the disclosure as indicated by detail area 6 in FIG. 1.

The rod 14 is coupled to and extends substantially perpendicularly from the second end 30 of the clippers 12, as shown in FIG. 6. The rod 14 is configured to be grasped in a hand of a user so that the user is positioned to manipulate the clippers 12 to position the portion of the toenail into the gap 22. The rod 14 is rectangularly shaped when viewed longitudinally.

A handle 38 is coupled to and extends from the rod 14 distal from the clippers 12. The handle 38 is configured to be positioned in a palm of the hand of the user. The handle 38 is rectangularly shaped when viewed longitudinally. The handle 38 extends codirectionally from the rod 14 with the clippers 12 so that the handle 38 is substantially parallel to the clippers 12, as shown in FIG. 1.

The actuator 16 is coupled to the rod 14 distal from the clippers 12. The actuator 16 is operationally coupled to the clip lever 18. The actuator 16 is configured to be selectively actuated by a digit of the hand that is grasping the rod 14 to lever the clip lever 18 to close the gap 22 to clip the portion of the toenail. The actuator 16 comprises a first bar 40 that is pivotally coupled to a terminus 42 of the clip lever 18 distal from the first end 24 of the clippers 12.

A retainer 44 is coupled to the rod 14 distal from the clippers 12, as shown in FIG. 6. The retainer 44 is slidably coupled to the first bar 40. The retainer 44 is positioned to retain the first bar 40 substantially parallel to the rod 14. The first bar 40 is configured to be urged by the digit of the hand grasping the rod 14 toward the clippers 12 to lever the clip lever 18 to close the gap 22 to clip the portion of the toenail. The retainer 44 comprises a bracket 46 that has opposing ends 48 that are coupled to the rod 14 so that the first bar 40 is encircled by the rod 14 and the bracket 46. The bracket 46 is C-channel 62 type.

A second bar 50 is coupled to and extends substantially perpendicularly from an upper endpoint 52 of the first bar 40, as shown in FIG. 6. The second bar 50 extends substantially in parallel with the handle 38. The second bar 50 is configured to be depressed with a thumb of the hand toward the handle 38 so that the first bar 40 is urged toward the clippers 12 to lever the clip lever 18 to close the gap 22 to clip the portion of the toenail.

A pair of arms 54 is coupled to and extends linearly from a lower endpoint 56 of the first bar 40 to define a pivot slot 58, as shown in FIG. 5. The clip lever 18 extends into the pivot slot 58. Each of a pair of pivot holes 60 is positioned in a respective arm 54. A channel 62 is positioned through the clip lever 18 so that the channel 62 is aligned with the pair of pivot holes 60. A pivot pin 64 is positioned through the pair of pivot holes 60 and the channel 62 so that the first bar 40 is pivotally coupled to the clip lever 18.

A lever slot 66 is positioned in the rod 14 proximate to the clippers 12, as shown in FIG. 5. The clip lever 18 extends through the lever slot 66 so that the terminus 42 of the clip lever 18 is positioned proximate to a back 68 of the rod 14. The clip lever 18 is positioned to be selectively urged from an upper limit 70 toward a lower limit 72 of the lever slot 66 as the first bar 40 is urged toward the clippers 12.

In use, the handle 38 is positioned in the palm of the hand of the user with the thumb of the hand positioned on the second bar 50. The handle 38 is used to manipulate the rod 14 to position the portion of the toenail in the gap 22. The second bar 50 then is depress with the thumb toward the handle 38, causing the first bar 40 to lever the clip lever 18, which closes the gap 22 to clip the portion of the toenail. The extra reach provided by the rod 14 facilitates clipping of toenails by reducing the reach required by the user to position the portion of the toenail in the gap 22 of the clippers 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A toenail clipping device comprising:

a clippers comprising a clip lever operationally coupled to a pair of cutters, the cutters being mutually coupled defining a gap positioned at a first end of the clippers wherein the gap is configured for inserting a portion of a toenail such that the clip lever is positioned for being selectively levered for closing the gap for clipping the portion of the toenail, the pair of cutters comprising an upper cutter coupled to a lower cutter adjacent to a second end of the clippers;

a hole positioned in the upper cutter proximate to the first end of the clippers;

a post coupled to the lower cutter and extending from the lower cutter through the hole, the clip lever being pivotally coupled to the post such that the clip lever extends from an upper face of the upper cutter;

a rod coupled to and extending substantially perpendicularly from the second end of the clippers such that the rod is configured for grasping in a hand of a user such that the user is positioned for manipulating the clippers for positioning the portion of the toenail into the gap, the rod being rectangularly shaped when viewed longitudinally;

a handle coupled to and extending from the rod distal from the clippers wherein the handle is configured for positioning in a palm of the hand of the user, the handle being rectangularly shaped when viewed longitudinally, the handle extending codirectionally from the rod with the clippers such that the handle is substantially parallel to the clippers;

an actuator coupled to the rod distal from the clippers, the actuator being operationally coupled to the clip lever wherein the actuator is configured for being selectively actuated by a digit of the hand grasping the rod for levering the clip lever for closing the gap for clipping the portion of the toenail, the actuator comprising:

a first bar freely pivotally coupled to a terminus of the clip lever distal from the first end of the clippers, a retainer coupled to the rod distal from the clippers, the retainer being slidably coupled to the first bar wherein the retainer is positioned for retaining the first bar wherein the first bar is configured for being urged by the digit of the hand grasping the rod toward the clippers for levering the clip lever for closing the gap for clipping the portion of the toenail, the retainer being a bracket having opposing ends coupled to the rod such that the first bar is extends through and is enclosed by the rod and the bracket, the bracket being C-channel type, a second bar coupled to and extending substantially perpendicularly from an upper endpoint of the first bar, the second bar having a length less than a length of the handle and extending substantially in parallel with the handle wherein the second bar is configured for depressing with a thumb of the hand toward the handle such that the first bar is urged toward the clippers for levering the clip lever for closing the gap for clipping the portion of the toenail, a pair of arms coupled to and extending linearly from a lower endpoint of the first bar defining a pivot slot, the clip lever extending into the pivot slot, a pair of pivot holes, each pivot hole being positioned in a respective arm, a channel positioned through the clip lever such that the channel is aligned with the pair of pivot holes, and a pivot pin positioned through the pair of pivot holes and the channel such that the first bar is pivotally coupled to the clip lever; and a lever slot positioned in the rod proximate to the clippers, the clip lever extending through the lever slot such that the terminus of the clip lever is positioned proximate to a back of the rod wherein the clip lever is positioned for being selectively urged from an upper limit toward a lower limit of the lever slot as the first bar is urged toward the clippers.

* * * * *